US005480255A

United States Patent [19]

Bernaquez et al.

[11] Patent Number: 5,480,255

[45] Date of Patent: Jan. 2, 1996

[54] IMPACT-ABSORBING BARRIERS FOR HIGHWAYS

[76] Inventors: Normand Bernaquez, 238, rue Claire, St-Eustache (Québec, Canada, J7P 4K5; Ivan Sabourin, 29, rue Armand, Côteau du lac (Québec), Canada, J0P 1B0

[21] Appl. No.: 354,501

[22] Filed: Dec. 12, 1994

[51] Int. Cl.[6] ..... E01F 15/00; E02D 29/02

[52] U.S. Cl. ..... 404/6; 52/DIG. 9; 405/284

[58] Field of Search ..... 52/DIG. 9; 256/13.1; 404/6; 405/16, 17, 284, 285

[56] References Cited

U.S. PATENT DOCUMENTS

| | | | |
|---|---|---|---|
| 4,142,821 | 3/1979 | Doring | 405/258 |
| 4,785,577 | 11/1988 | Lederbauer | 404/6 X |
| 5,056,961 | 10/1991 | McMeans et al. | 405/284 |
| 5,238,228 | 8/1993 | Moon | 256/13.1 |
| 5,378,088 | 1/1995 | Foehrkolb | 405/284 |

FOREIGN PATENT DOCUMENTS

| | | | |
|---|---|---|---|
| 3829615 | 3/1990 | Germany | 52/DIG. 9 |
| 7714213 | 6/1979 | Netherlands | 256/13.1 |

OTHER PUBLICATIONS

"Holding up a bank . . . old tires, filled with dirt", from unknown publication, p. 131 (Mar. 1976), Class 52, DIG. 9.

*Primary Examiner*—Ramon S. Britts
*Assistant Examiner*—James A. Lisehora
*Attorney, Agent, or Firm*—Pierre Lespérance; François Martineau

[57] ABSTRACT

The road-guard construction comprises a first wall of superimposed whole tires disposed horizontally in vertical rows and horizontal columns. A second wall of superimposed half tires—which are cut circumferentially along their tread path, is also disposed in vertical rows and horizontal columns. Each half-tire defines a toroidal chamber, facing upwardly. Tie-bands interconnect the whole tires to the half-tires, whereby a single integral wall unit is achieved. Sand is poured into the toroidal chambers of the half-tires, whereby the first and second walls become firmly anchored to the ground. The road-guard will therefore remain substantially immobile over ground even after repeated vehicle impacts.

13 Claims, 5 Drawing Sheets

IMPACT-ABSORBING BARRIERS FOR HIGHWAYS

FIELD OF THE INVENTION

This invention relates to upright wall constructions, and particularly road-side ramps, tidal river embankments, and the like upright ground-anchored barricades.

BACKGROUND OF THE INVENTION

U.S. Pat. No. 5,238,228 issued in August 1993 to Daniel MOON, discloses the idea of using spent motor vehicle tires as road guards, with the tires being cut in halves by cutting each complete tire circumferentially along its tread path. The tire halves are nested into one another and vertically stacked, and are vertically interconnected by vertically extending tie bands.

U.S. Pat. No. 4,142,821 issued in March 1979 to Erich Döring, discloses the concept of a planar horizontal arrangement of a plurality of spent motor vehicle tires, with each pair of adjacent tires being interconnected at their circumferential sections by horizontally extending tie-bands.

One problem with these road-guards is that they have no inherent means for ground anchoring, so that they are liable to accidental displacement over ground.

OBJECTS OF THE INVENTION

The main object of the invention is therefore to improve upon existing road guards, by providing anchoring means for the spent tires used as road guards, which are integral thereto.

A corollary object of the invention is provide such tire-based road guards, which are of very low manufacturing cost.

SUMMARY OF THE INVENTION

In accordance with the objects of the invention, there is disclosed a road-guard construction for absorbing blows from accidentally impacting vehicles, comprising: (a) a first wall of superimposed whole tires disposed in vertical rows and horizontal columns, each said whole tire defining a tread band, the planes intersecting said tread bands thereof of all said whole tires being oriented horizontally, said first wall adapted to be directly impacted by said vehicles about free outer tread band sections thereof; (b) a second wall of superimposed half tires cut circumferentially along their tread path, also disposed in vertical rows and horizontal columns, each said half-tire defining a toroidal chamber, said toroidal chamber facing upwardly; (c) means for interconnecting said first and second walls as a single integral wall unit; and (d) means for filling at least several of said upwardly facing half-tire toroidal chambers with a high-density material, whereby said first and second walls become firmly anchored to the ground; wherein said road-guard will remain substantially immobile over ground even after repeated vehicle impacts.

Preferably, at least some of said whole tires and of said half-tires are spent tires with thin worn-out tread bands.

Said tire interconnecting means could include first tie-band means, for interconnecting in substantial contacting engagement each pair of adjacent said whole tire and said half-tire from a horizontally registering horizontal column of whole tires and half-tires; second tie-band means, for interconnecting in substantial contacting engagement each pair of adjacent said whole tires from a horizontally registering horizontal column thereof to one another; as well as third tie-band means, for interconnecting in substantial contacting engagement each pair of adjacent said half tires from a horizontally registering horizontal column thereof to one another. Alternately, with each whole tire defining a pair of opposite side walls and each pair of successive said whole tires from a vertical row of whole tires defining therebetween a frusto-conical annular cavity therebetween, said tire interconnecting means could include the engagement of a circumferential section of an adjacent said half-tire from a horizontally registering horizontal column thereof, edgewisely and frictionally into a corresponding section of said annular cavity.

The high density material could be a granular material, for example, sand.

Preferably, at least a third wall is provided, being made up of superimposed tires at least some of which are whole tires, and at least some other of which are half-tires filled with high-density ground-anchoring material; the location of said at least third wall being selected from the group consisting of: a location in between said first and second walls; and a location against said second wall opposite said first wall.

The present invention also relates to a method of construction of a ground-anchored road-guard, said road-guard being made of a first wall of whole tires and of a second wall of sand-filled half-tires; wherein the method of construction includes the following steps: (a) laying a first lowermost horizontal row of half-tires over ground; (b) filling the toroidal chamber of said half-tires with sand; (c) laying a second lowermost horizontal row of half-tires over said first horizontal row; (d) filling the toroidal chamber of said half-tires of the second row with sand; (e) laying at least one additional horizontal row of half-tires over said second lowermost horizontal row of half-tires; (f) filling with sand the toroidal chamber of said half-tires of said at least one additional horizontal row; (g) vertically stacking a plurality of horizontal rows of whole tires against the vertically stacked said horizontal rows of half-tires; and (h) attaching selected said whole tires from a given horizontal row of whole tires to selected said half-tires from a horizontally registering horizontal row of half-tires; whereby a unitary immobile double wall construction is achieved.

DETAILED DESCRIPTION OF THE DRAWINGS

Figure 1:
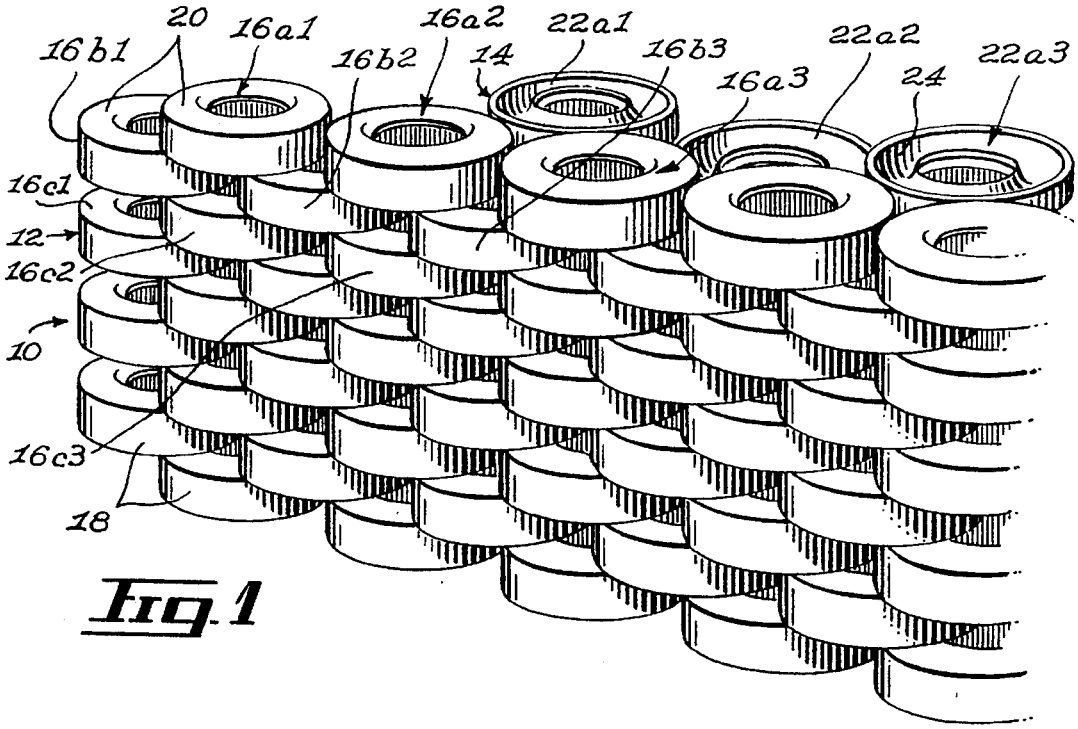
FIG. 1 is a perspective view of a road guard according to the invention, before sand filling.
Figure 2:
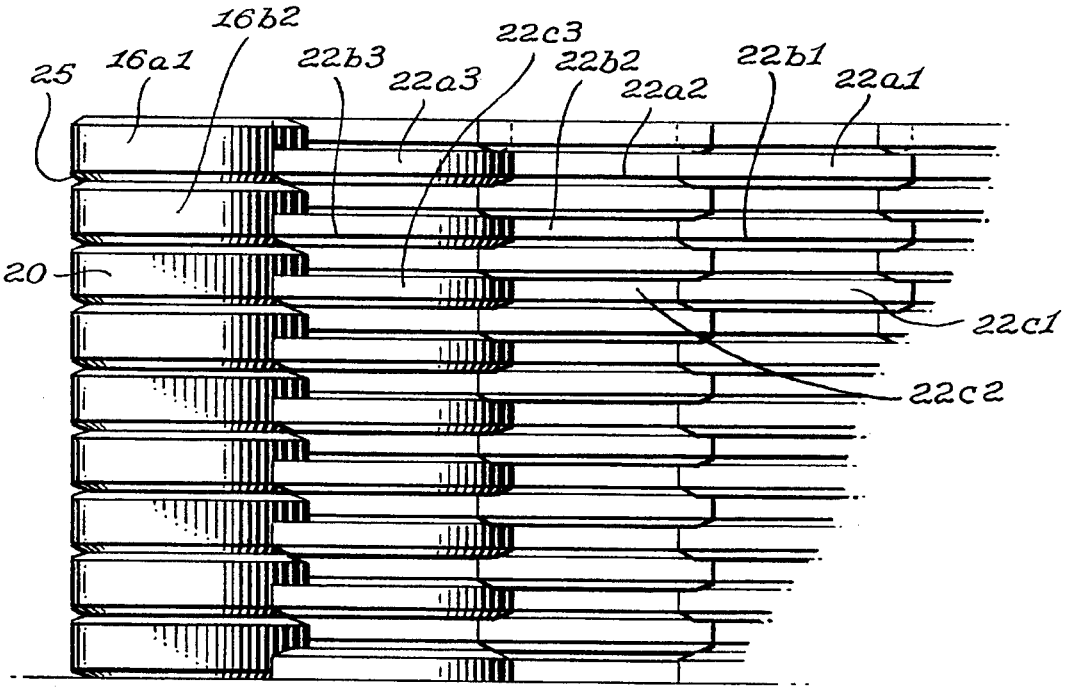
FIG. 2 is an elevational view of part of the road guard of FIG. 1.
Figure 3:
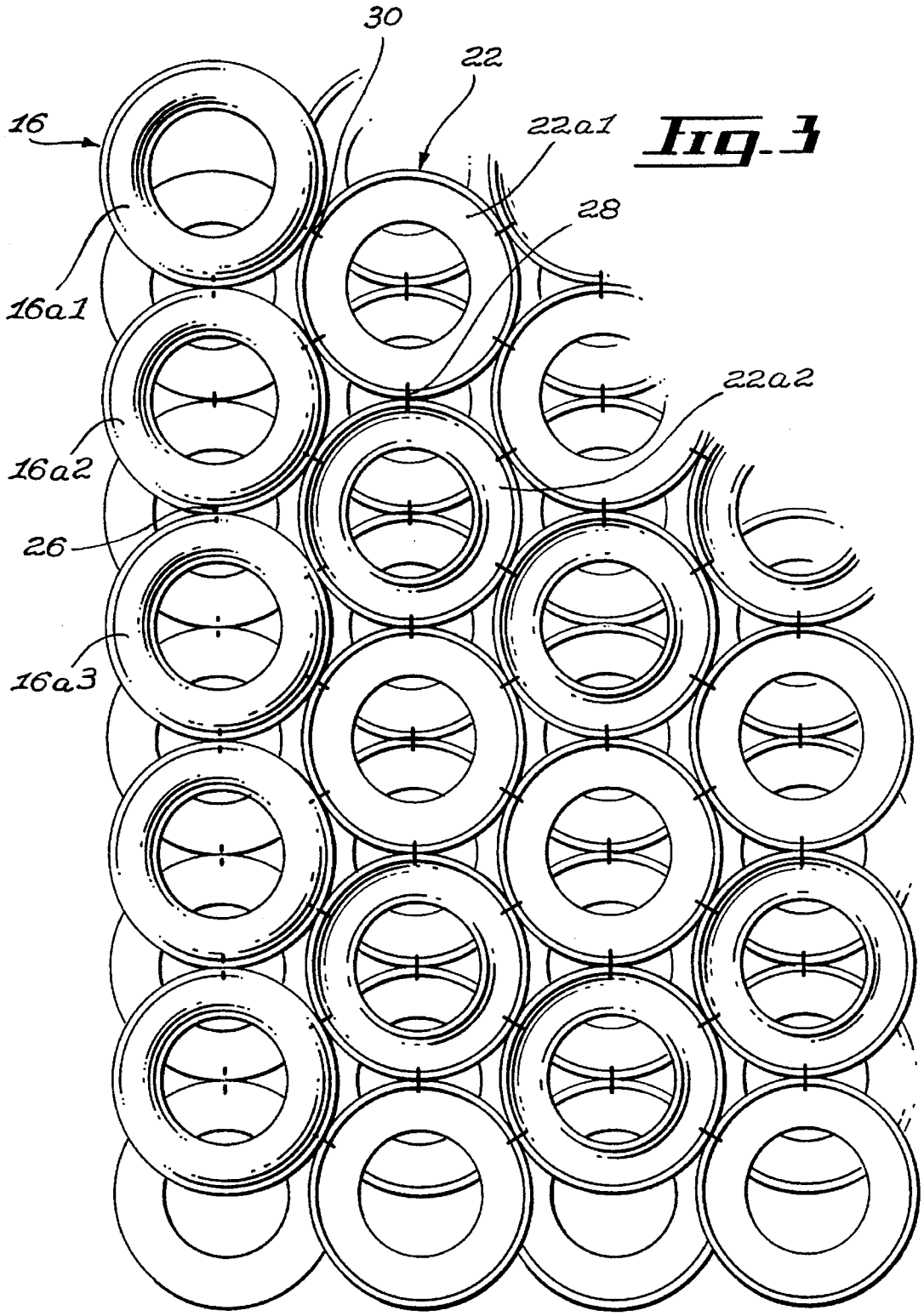
FIG. 3 is a top plan view of the road guard of FIG. 1.

The road guard 10 illustrated in FIGS. 1, 2 and 3 consists of a first leading wall of vertically stacked, spent, whole tires, 12, and a second trailing wall of vertically stacked, spent, half-tires, 14. Each of the whole tires 12 and half tires 14 is horizontally disposed, i.e. laying flat against one side wall thereof. The number of vertically stacked horizontal layers of whole tires 16 may be for example nine, as illustrated.

The tire arrangement for first wall 12 preferably consists of:

whole tires 16a1, 16a2, 16a3, . . . , which form the uppermost horizontal layer of whole tires;

whole tires 16b1, 1662, 1663, . . . , which form the second uppermost horizontal layer of whole tires;

whole tires 16c1, 16c2, 16c3, . . . , which form the third uppermost horizontal layer of whole tires;

and so on until the ninth (lowermost) layer of whole tires is reached.

Each pair of horizontally successive tires, e.g. 16b1 and 16b2, abut against each other by a tangential section of their adjacent circumferential tread band 18, along a single generally horizontal plane. Each triplet of successive vertically stacked whole tires, e.g. 16b2, 16c2, and 16c3, are horizontally offset, as shown, so that the overlying tire 16b2 be supported at two opposite sections of its side wall 20, by registering sections of the side walls 20 of the pair of underlying tires 16c2, 16c3.

The second wall 14 includes several vertically stacked half tires and horizontally spaced apart half tires, 22, each half tire 22 being cut in half by cutting a complete (preferably worn-out) tire circumferentially along its tread path, wherein a toroidal cavity or open chamber 24 is obtained within the half tire 22. The mouth of annular chamber 24 should face upwardly; or alternately, vertically stacked half-tires 24 would alternate successively, the uppermost facing upwardly, the next one downwardly, the next one upwardly, the next one downwardly, . . . , so that an internesting arrangement be achieved. A tire arrangement similar to first wall 12 is achieved, whereby:

half tires 22a1, 22a2, 22a3, ... form the uppermost horizontal layer of half tires;

tires 22b1, 22b2, 22b3, ... form the second uppermost horizontal layer of half tires;

tires 22c1, 22c2, 22c3, ... form the third uppermost horizontal layer of half tires;

and so on until the lowermost layer is reached.

As clearly illustrated in FIG. 2, the half tires of each horizontal row, e.g. 22a1, 22a2, . . . of the aft wall 14, are positioned relative to whole tires 16 of the first wall 12 so as to complementarily engage and nest within a portion of the generally annular horizontal cavity 25 formed by the self-abutting side walls 20 of a successive pair of vertically stacked, registering whole tires 16a1, 16b2. Cavity 25 is generally frusto-conical in cross-section. The lowermost layer of second wall 14, as can be also seen in FIG. 2, preferably comprises half tires whose toroidal chambers are downwardly oriented, these half tires nesting themselves between the annular horizontal cavity 25 of whole tires 16 and the ground. To accomplish this nesting of the lowermost layer, it may be necessary to dig the peripheral edge, resulting from the circumferential cut of the tread path, into the ground. This would be even preferable, since the purpose of this lowermost layer of half tires is to anchor more solidly inner wall 14. Indeed, this peripheral edge of half tires 22 can be much more frictionally engaged with the ground than the smooth round convex part of the tire. As a result, inner wall 14 would be more difficult to move, and barrier 10 would therefore be more effective. First tie bands 26 interconnect each pair of horizontally successive whole tires 16, e.g. 16a1 and 16a2, by extending around the corresponding side wall sections of the two tires before being tied tightly in place. Second tie bands 28 interconnect each pair of horizontally successive half-tires 22, e.g. 22a1 and 22a2, by extending around the tread band and over the single remaining side wall of each half tire and tied tightly in place. Third tie bands 30 interconnect each pair of horizontally registering whole tire 16 and half tire 22, e.g. 16a1 and 22a1, and tied tightly in place.

Tie bands 26, 28, 30, may be of the same construction and tire interconnection arrangement as those disclosed in the Döring patent, supra.

Figure 4:
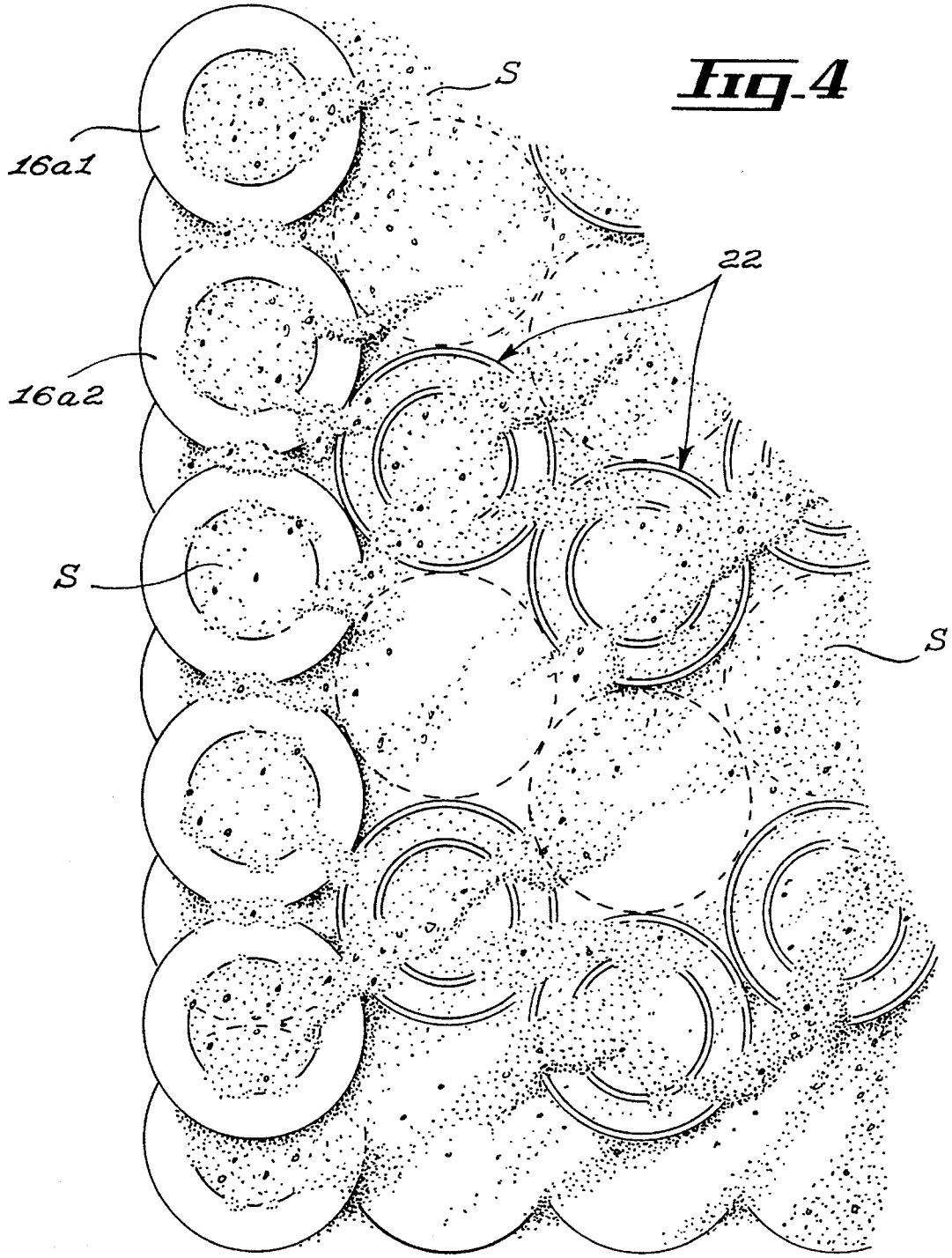
FIG. 4 is a view similar to FIG. 3, but after sand filling of the tire halves.

As suggested in figure.4, the annular chambers 24 of the half tires 22—which should all face upwardly—are filled with sand S, or other granular material, to substantially increase the overall weight of each half tire 22. Moreover, sand S is also poured through the circular radially inner mouth of each whole tire 16, where at least some sand remains trapped, whereby the weight of front wall 12 is increased. Accordingly, both the front tire wall 12, and especially the aft half-tire wall 14—that is to say, the whole road guard 10—becomes anchored to the ground. The loaded sand inside the half tires and into the central through-bores of the whole tires should be of such total weight as to anchor the road guard 10 to ground and to maintain such road guard anchored to ground, even after high-load impact from a motorist hitting the road guard at high speed.

It is preferable that the toroidal chamber formed in each of the whole tires 16 from the first tire wall 12 be empty of sand, so that the sandless tire wall provide a resilient shock absorbing layer that will minimize structural damages to the vehicle hitting the road guard.

Sand filling can be achieved in a simple fashion, simply through operation of a dump truck:

1. the first lowermost layer of half tires 22 is laid over ground;

2. sand is poured thereover;

3. the second lowermost layer of half tires 22 is laid over the first layer;

4. sand is again poured thereover;

5. the third lowermost layer of half tires 22 is laid over the second layer;

6. sand is again poured thereover;

and so on until the uppermost layer of half tires 22 is laid, whereupon the aft wall 14 becomes completely erected. Substantially all toroidal chambers 24 of half tires 22 should preferably be filled with sand, to ensure firm anchoring .of wall 14 to the ground.

Figure 5:
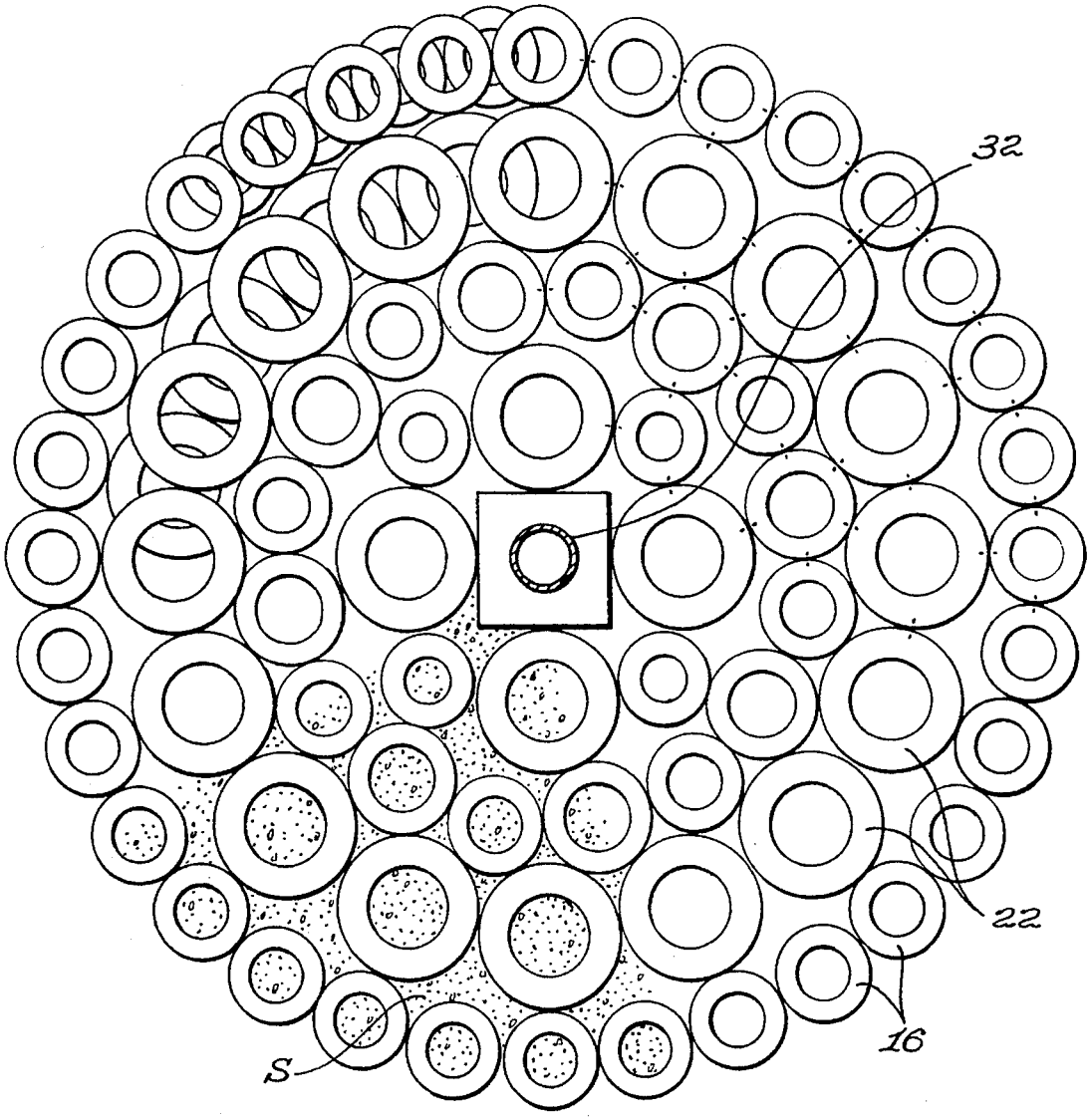
FIGS. 5 and 6 are top plan views of two different road guard layouts according to the invention.
Figure 6:
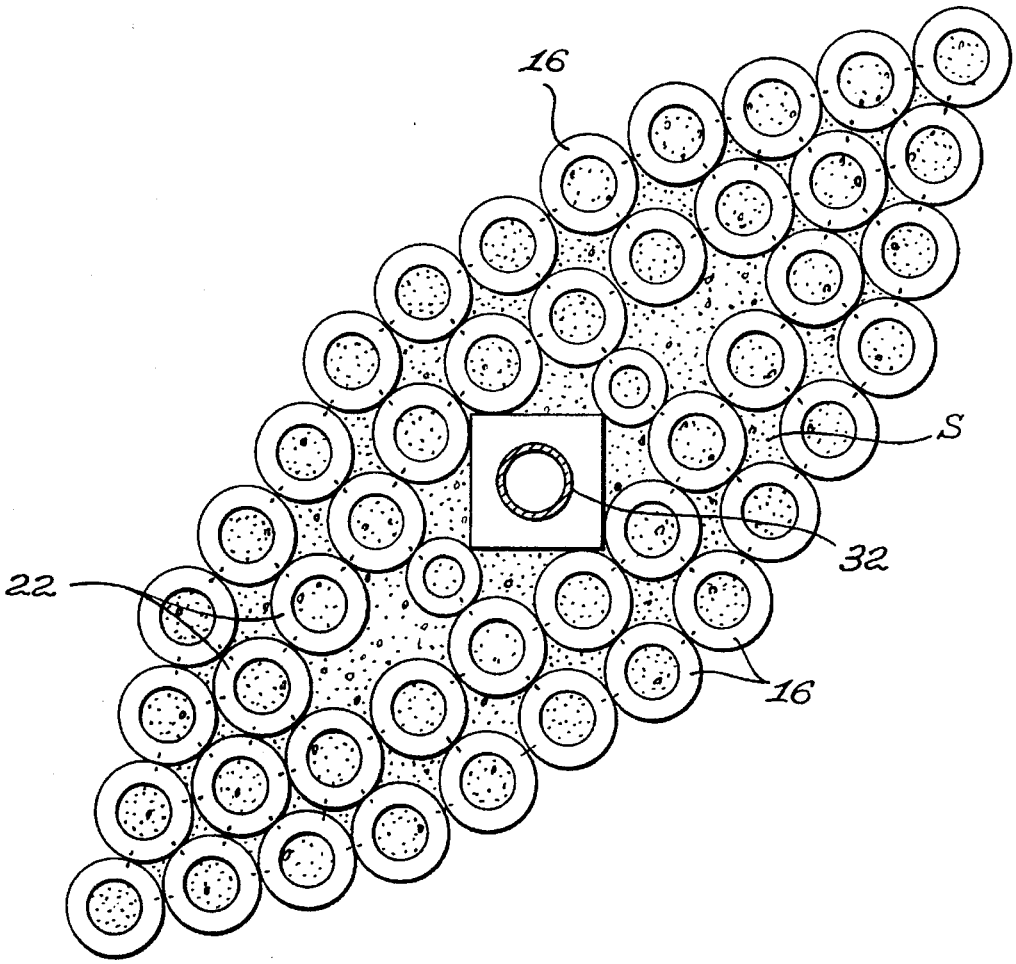

FIGS. 5 and 6 show various road-guard tire arrangements, with more than two walls of tires 16 and half tires 22.

In FIG. 5, for example, four tire and half tire walls 12, 14, are formed concentrically to a lamp post 32. The tires or half-tires are of varying diameters. Some sectors of the multiple wall assembly, which would be estimated as being more susceptible of sustaining multiple impacts, could be denser with tires than others, e.g. along the radially outermost wall of the top end portion of FIG. 5. Again, the radially outermost layer should be made of whole tires 16; the second radially outermost layer should also preferably be made of whole tires 16, although at least some of the tires could be sand-filled ground anchoring half tires 22; the third radially outermost layer may also be made of whole tires 16, although at least a number if not all of the tires could be sand-filled ground anchoring half tires 22; and the last radially innermost wall of tires should preferably be made of whole tires, so as not to unduly damage the lamp post 32, although at least some sand-filled ground-anchoring half tires 22 would not be excluded as possible elements of the radially innermost wall of tires.

FIG. 6 is similar to FIG. 5, except that the tire distribution around lamp post is more of the type described in FIGS. 1–3, with a first outer layer of whole tires 16 and a second inner wall of sand-filled, ground anchoring half tires 22.

Since the tires used are preferably spent i.e. worn-out ones, the materials used for the construction of the road guard are "free", since worn-out tires have no intrinsic value, and sand can usually be found on the premises where the road-guard is to be erected. Moreover, any structural damage to the road-guard can therefore easily repaired, since sand as well as tire fragments can still be recycled; only the tie-bands linking the tires in pairs may need to be replaced by new ones.

The wall assembly made of whole tires and half tires, according to the invention, is not limited to road-guards. Other industrial applications are considered to be well within the scope of the present invention. For example, it is envisioned to use such a wall assembly as:

(a) the median raised strip of ground defining the intermediate separating section of divided motorhighways;

(b) a raised barricade along the side of a mountainous road, adjacent a steep-sloped, rock-fall prone or snow avalanche prone cliff, for shielding motorists against falling boulders or snow avalanche;

(c) as an upright embankment or breakwater along a shore, to control water movements in tidal rivers or to shield shore buildings against pack ice during unthawing seasons in temperate winter-freezing climates.

Accordingly, whenever the expression "road-guard" is used herein, it should be understood to extend to any one of the upright wall structures disclosed above (highway median dividing strip, boulder controlling road barricade, tidal and unthawing river embankment).

This wall construction could in some cases be used as a ground-stabilizing horizontal boardwalk, being partly or totally embedded into ground, to prevent accidental landslides or subsidence (the half-tires being internested in single pairs relative to one another along the horizontal layer).

The embodiments of the invention for which an exclusive property or privilege is claimed, are defined as follows:

1. An upright wall construction for absorbing transverse impacting blows, comprising:

(a) a first wall of superimposed whole tires disposed horizontally in vertical rows and horizontal columns, each said whole tire defining a tread band, said first wall adapted to directly sustain the impact blows about free outer tread band sections thereof;

(b) a second wall of superimposed half tires cut circumferentially along their tread path, also disposed horizontally in vertical rows and horizontal columns, each said half-tire defining a toroidal chamber, said toroidal chamber opening upwardly;

(c) means for interconnecting said whole tires and said half-tires, whereby said first and second walls form a single integral wall unit; and (d) means for filling at least several of said upwardly facing half-tire toroidal chambers with a high-density material, whereby said first and second walls become firmly anchored to the ground; wherein said wall construction will remain substantially immobile over ground even after repeated impact blows.

2. An upright wall construction as defined in claim 1, wherein at least some of said whole tires and of said half-tires are spent tires with thin worn-out tread bands.

3. An upright wall construction as defined in claim 1, wherein said tire interconnecting means includes first tie-band means, for interconnecting in substantial contacting engagement the tread bands of each pair of adjacent said whole tire and said half-tire from a horizontally registering horizontal column of whole tires and half-tires.

4. An upright wall construction as defined in claim 3, wherein said tire interconnecting means further includes second tie-band means, for interconnecting in substantial contacting engagement the tread bands of each pair of adjacent said whole tires from a horizontally registering horizontal column thereof to one another.

5. An upright wall construction as defined in claim 6, wherein said tire interconnecting means further includes third tie-band means, for interconnecting in substantial contacting engagement the tread bands of each pair of adjacent said half tires from a horizontally registering horizontal column thereof to one another.

6. An upright wall construction as defined in claim 1, wherein said high density material is a granular material.

7. An upright wall construction as defined in claim 6, wherein said granular material is sand.

8. An upright wall construction as defined in claim 1, with each whole tire defining a pair of opposite side walls, and each pair of successive said whole tires from a vertical row of whole tires defining therebetween an annular cavity therebetween; wherein said tire interconnecting means further includes the engagement of a circumferential section of an adjacent said half-tire from a horizontally registering horizontal column thereof, edgewisely and frictionally into a corresponding section of said annular cavity.

9. An upright wall construction as defined in claim 1, further including at least a third wall made up of superimposed tires at least some of which are whole tires, and at least some other of which are half-tires filled with high-density ground-anchoring material; the location of said at least third wall being selected from the group consisting of: a location in between said first and second walls; and a location against said second wall opposite said first wall.

10. An upright wall construction as defined in claim 1, wherein said second wall of superimposed half tires further includes another set of half-tires, each with its said toroidal chamber opening downwardly and mounted between each pair of successive first mentioned vertically stacked half-tires, whereby all said half-tires internest with one another.

11. An upright wall construction as defined in claim 1, wherein said second wall of superimposed half tires further includes an additional lowermost layer of half tires, each with its said toroidal chamber opening downwardly for resting on the ground with the peripheral edge resulting from the circumferential cut of said tread path, whereas said lowermost layer confers an enhanced anchoring capacity to said wall construction.

12. A method of construction of a ground-anchored wall construction, said wall construction being made of a first wall of whole tires and of a second wall of upwardly facing, sand-filled half-tires; wherein the method of construction includes the following steps:

(a) laying a first lowermost horizontal row of half-tires over ground;

(b) filling the upwardly facing toroidal chambers of said half-tires with sand;

(c) laying a second lowermost horizontal row of half-tires over said first horizontal row;

(d) filling the upwardly facing toroidal chambers of said half-tires of the second row with sand;

(e) laying at least one additional horizontal row of half-tires over said second lowermost horizontal row of half-tires;

(f) filling with sand the toroidal chambers of said half-tires of said at least one additional horizontal row;

(g) vertically stacking a plurality of horizontal rows of whole tires against the vertically stacked said horizontal rows of half-tires; and (h) attaching selected said whole tires from a given horizontal row of whole tires to selected horizontally registering said half-tires; wherein a unitary immobile double wall construction is achieved.

13. A method of construction of a road-guard as in claim 12, further including the additional step of filling with sand at least some of the circular radially inward channels formed by said whole tires.

* * * * *